United States Patent [19]

Winstrøm-Olsen

[11] Patent Number: 4,534,800

[45] Date of Patent: Aug. 13, 1985

[54] PROCESS AND APPARATUS FOR THE PRODUCTION OF SUGAR THICK JUICE FOR THE MANUFACTURE OF SUGAR

[75] Inventor: Bjarne Winstrøm-Olsen, Nakskov, Denmark

[73] Assignee: Aktieselskabet de Danske Sukkerfabrikker, Copenhagen, Denmark

[21] Appl. No.: 554,681

[22] Filed: Nov. 23, 1983

[30] Foreign Application Priority Data

Nov. 24, 1982 [DK] Denmark ..... 5237/82

[51] Int. Cl.[3] ..... C13D 3/06

[52] U.S. Cl. ..... 127/12; 127/13; 127/48; 127/50; 127/52; 127/61; 159/DIG. 8

[58] Field of Search ..... 127/11-14, 127/48-52, 61, 62; 159/17 R, 17 C, DIG. 8

[56] References Cited

U.S. PATENT DOCUMENTS

| | | | |
|---|---|---|---|
| 2,391,843 | 12/1945 | Rawlings | 127/50 |
| 2,610,932 | 9/1952 | Eakin | 127/13 |
| 3,834,941 | 9/1974 | Schoenrock et al. | 127/52 |
| 4,290,818 | 9/1981 | Huber et al. | 127/52 |
| 4,424,078 | 1/1984 | Schiweck et al. | 127/52 |

FOREIGN PATENT DOCUMENTS

| | | | |
|---|---|---|---|
| 2934964 | 3/1981 | Fed. Rep. of Germany | 127/61 |

*Primary Examiner*—Peter Hruskoci

*Attorney, Agent, or Firm*—Watson, Cole, Grindle & Watson

[57] ABSTRACT

In a process for the production of sugar thick juice from lime-containing raw juice and wherein carbon dioxide and soda are added to the lime-containing raw juice in at least one carbonation step, and wherein the thin juice is preheated and evaporated to form thick juice, ammonia in the form of gaseous spent heating medium originating from the preheating of the thin juice is added to the lime-containing raw juice. The method of the invention results in a reduction of the consumption of soda in the carbonation step and in an increased sugar yield.

6 Claims, 1 Drawing Figure

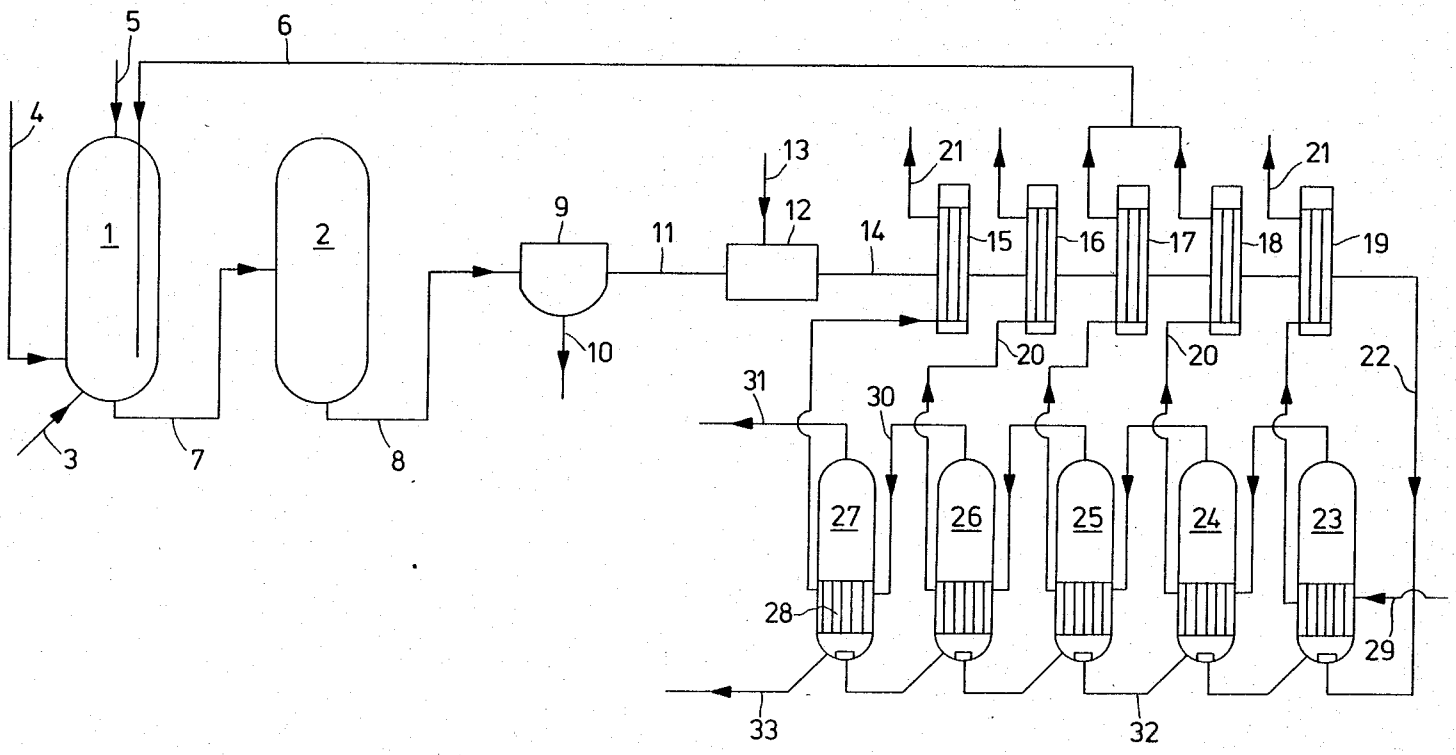
1
2
3
4
5
6
7
8
9
10
11
12
13
14
15
16
17
18
19
20
21
22
23
24
25
26
27
28
29
30
31
32
33

PROCESS AND APPARATUS FOR THE PRODUCTION OF SUGAR THICK JUICE FOR THE MANUFACTURE OF SUGAR

BACKGROUND OF THE INVENTION

This invention relates to a process for the production of sugar thick juice from lime-containing raw sugar juice, the method comprising the steps of subjecting the lime-containing raw sugar juice to at least one treatment with carbon dioxide and soda to precipitate calcium salts, separating the precipitated calcium salts from the juice to form a thin juice, preheating the thin juice thus obtained and evaporating the thin juice to form a thick juice, the gaseous effluent obtained during the evaporation of the preheated thin juice being used as an indirect heating medium for the preheating of the thin juice.

In the conventional manufacture of crystalline sugar from sugar juice obtained by extraction of sugar beet slices, the extraction juice is purified in a liming step followed by at least one and ordinarily two carbonation steps. The liming, which comprises the addition of lime to the extraction juice has a dual purpose, namely of forming precipitates comprising non-sugars and calcium oxide, which precipitates subsequently are separated by filtration, and of decomposing such compounds, such as amino acids, glucose and fructose, which do not form precipitates when reacted with calcium oxide and which adversely affect the further sugar production steps, unless they are decomposed.

The carbonation, which ordinarily includes two steps, comprises the addition of carbon dioxide to the limed sugar juice in order to precipitate excessive amounts of lime in the form of calcium carbonate which subsequently is removed by filtration. Since it has been found that an insufficient alkalinity of the juice or an inefficient extraction which may occur at the end of the sugar beet campaign makes it difficult to remove excessive amounts of lime during the second carbonation, it is normal practice to supplement the addition of carbon dioxide during the carbonation, and particularly during the second carbonation, with an addition of soda. The soda consumption constitutes a significant expenditure in the purification of sugar juice. Furthermore, the sodium ions thus introduced have an adverse effect on the sugar crystallisation step and cause sugar to be transferred to the molasses, thus reducing the sugar yield.

The sugar juice obtained when the calcium carbonate formed during the second carbonation has been removed by filtration may optionally be subjected to a further treatment with sulphurous acid. The treatment with sulphurous acid partly causes the pH value of the juice to be adjusted and partly to reduce the discolouration in the evaporator. Due to the adjustment of the pH value, the decomposition of saccharose in the evaporator is minimized.

The purified thin juice is then preheated before it is evaporated to form thick juice. The thick juice is introduced into the boilers in which it is further evaporated to effect a crystallization of sugar crystals which are separated and worked up.

The preheating is ordinarily effected in a row of preheaters connected in series, and a similar number of evaporators also connected in series is used for the evaporation of the thin juice. The evaporation of the thin juice is effected, e.g., by using steam formed in a preceding evaporator in the row of evaporators as heating medium in the following evaporator and by indirectly using spent heating medium from one evaporator as heating medium in a heat exchanger in the corresponding preheater in the row of preheaters. Up to now the gaseous heating medium from the heat exchangers in the preheaters has been discharged to the atmosphere, optionally through the vacuum system of the sugar factory.

SUMMARY OF THE INVENTION

The invention is based on the discovery that by using in the first and/or the second carbonation steps spent heating medium from the preheaters, which medium contains substantial amounts of ammonia, the amount of soda for deliming the sugar juice can be considerably reduced.

Tests, for example, have shown that the consumption of soda during the second carbonation step can be reduced by 18–42%, depending on the stage of the sugar beet campaign. The strongly diverging results are due to the fact that, particularly at the end of the sugar campaign, the sugar juice obtained has an insufficient natural alkalinity and that the extraction process during this stage of the campaign normally results in juice of a lower quality than under the first part of the campaign.

As a result of the reduction of the consumption of soda, also the loss the sugar is reduced.

The process of the invention is characterized in that the gaseous medium formed during the preheating is added to the limecontaining raw sugar juice in connection with the carbonation.

H. Zaorska and S. Zagrodzki disclose in an article: Methode zur Saftentkalkung mit Hilfe von Ammoniak und Soda, Zucker 25 (1972), No. 23, pages 753–755 a method for the removal of calcium salts from raw juice, wherein the raw juice following the second carbonation is treated with ammonia and ammonium carbonate and wherein the ammonium carbonate and part of the ammonia are prepared by introducing filtrated thin juice into a regeneration column and by heating the thin juice to its boiling point. The gaseous medium thus formed can be used for preheating of the delimed juice before it is used for the above-mentioned treatment. This prior art method requires the use of the separate regeneration column and further suffers from the drawback that the acidity of the juice is increased due to the regeneration treatment, and the increased acidity creates corrosion problems during the preheating and evaporation of the juice.

It is also well known see (German patent specification No. 25 57 865) that waste water and in particular waste water, which has been used for the transportation of sugar beets, as well as wash water can be neutralized by subjecting condensate obtained by the evaporation of sugar juice to a vacuum in order to remove ammonia therefrom and by adding the ammonia thus formed to the waste water. In this method the ammonia obtained is not recycled to the raw juice.

The preheating of the thin juice in the method of the invention is preferably effected in a row of preheaters connected in series and the preheated thin juice is subsequently passed through a row of evaporators connected in series. Spent heating medium from the latter is preferably used for the preheating of the thin juice in the preheaters.

Ordinary steam under a pressure of 1.5–2.5 atm is normally introduced in the heat-exchanger section of the first evaporator in the row of evaporators. The pressure decreases through the row of evaporators in a manner which depends on the existing operational conditions. The pressure conditions within the individual evaporators determine the preheaters from which gaseous medium is to be discharged and introduced in the lime-containing raw sugar juice in connection with the carbonation.

In the process of the invention the spent heating medium from the preheaters can be added to the lime-containing raw juice at various stages during its work-up. However, the addition is preferably effected in connection with the second carbonation step. It is particularly preferable to introduce spent heating medium in the first container in the second carbonation step. This is advantageously effected by liberating the medium in the juice in the second carbonation container at a level which is located 3–5 meters below the liquid surface, e.g., from the end of a pipe opening into the liquid 3–5 meters below the liquid surface.

After the second carbonation the juice typically has a pH value of 9.0–9.2. The major part of the ammonia supplied during the second carbonation step is, therefore, in the form of ammonium ions and the ammonia consequently can replace sodium ions from the soda.

By using gaseous medium from such preheaters in which the pressure is superatmospheric, no special auxiliary means are required in order to introduce the gaseous medium into the lime-containing raw juice.

The invention also relates to an apparatus for the production of sugar thick juice from lime-containing raw juice. The apparatus comprises at least one carbonation container having means for introducing lime-containing raw juice into the container and means for removing carbonation juice therefrom, means for separating precipitated salts from the carbonation juice so as to form thin juice, a plurality of preheaters connected in series and having means for indirectly heating the thin juice and a plurality of evaporators connected in series for evaporating the preheated thin juice so as to form thick juice, the steam chamber of at least one evaporator being connected with the means for indirectly preheating the thin juice in one of the preheaters.

The apparatus of the invention is characterized in that the means for indirectly preheating the thin juice in the preheater are connected with means for transferring spent gaseous heating medium from the preheater to the carbonation container.

In a preferred embodiment of the invention the noted means comprises a pipe opening into the carbonation container at a level located 3–5 meters below the normal level of the liquid surface.

The invention will be described in further detail with reference to the drawing which schematically shows an apparatus according to the invention.

The drawing illustrates a first container 1 and a second container 2 of the second carbonation station of a plant for the production of sugar. Juice from the first carbonation station is introduced into the container 1 through a conduit 3. The container 1 comprises two additional conduits 4 and 5 for the introduction of carbon dioxide and soda, respectively. Furthermore, a recycle conduit 6, which will be described in further detail below, is connected with the container 1. The conduit 6 opens into the container in the lower part thereof.

The container 1 is connected with the second container 2 through a conduit 7 and the second container 2 comprises a bottom discharge opening which through a conduit 8 is connected with a filter 9 for the removal of sludge formed during the second carbonation step. The filter 9 which comprises the sludge discharge conduit 10 is connected with a conduit 11 which in turn is connected with a container 12 having an inlet conduit 13 for the introduction of sulphurous acid. A conduit 14 connects the container 12 with the first of five preheaters 15–19 mounted in series. Each preheater comprises a heat-exchanger having an inlet pipe 20 for heating medium and a discharge pipe 21 for spent heating medium. The discharge pipes 21 from the preheaters 17 and 18 and connected with the above-mentioned recycle conduit 6, whereas the remaining discharge pipes are connected with the vacuum system of the plant.

The last preheater 19 in the row of preheaters comprises a conduit 22 which is connected with the first evaporator 23 of a row of evaporators 23–27 connected in series. Each evaporator comprises a heat-exchanger section having an inlet pipe 30 for heating medium and a discharge pipe which is identical to the inlet pipe 20 for the corresponding preheater. An inlet pipe 29 for the heat-exchanger section of the first evaporator 23 may be connected with a steam turbine (not shown), and the inlet pipes 30 for the remaining evaporators 24–27 are connected with the top of the preceding evaporator in the row of evaporators 23–26. The top of the last evaporator 27 is connected with a discharge pipe 31 which in turn is connected with a vacuum source (not shown). The lower ends of the evaporators 23–26 are interconnected through conduits 32 and the last evaporator 27 comprises a discharge pipe 33 for thick juice.

The apparatus illustrated operates in the following manner:

Filtrate obtained after removal of precipitation products formed during the first carbonation step is introduced through the conduit 3 into the first container 1. During its stay within the container 1, carbon dioxide and soda are added to the filtrate through the conduits 4 and 5, respectively, and ammonia-containing effluent from the preheaters 17 and 18 is introduced through the recycle conduit 6. The mixture thus obtained is passed through the conduit 7 into the second container 2 in which a final deliming reaction takes place. The mixture of sugar juice and sludge thus formed is passed from the bottom of the container 2 through the conduit 8 into the filter 9 in which the sludge is removed by filtration and is discharged through the conduit 10. The filtrate thus obtained is passed through the conduit 11 into the container 12 in which sulphurous acid is added to the filtrate through the conduit 13. The thin juice thus prepared is passed through the preheaters 15–19 in which the temperature is gradually increased, e.g. to about 130° C., by indirect heating by means of a gaseous medium introduced through the pipes 20. The spent heating medium discharged from the preheaters 17 and 18 and having a pressure of about 0.5 atm is collected in the recycle conduit 6 and, as explained above, it is introduced into the juice originating from the first carbonation step and contained in the container 1. The preheated thin juice is passed through the pipe 22 into the evaporator 23 and is subsequently passed from one evaporator to the following through the connecting pipes 32 and is finally discharged in the form of thick juice through the discharge pipe 33.

The evaporation of the sugar juice in the evaporators 23–27 is effected by introducing steam into the heat-exchanger section of the evaporator 23 and by using the steam formed as a result of the evaporation in the evaporator 23 as heating medium in the following evaporator 24 and similarly in the following evaporators. Thus, the steam discharged from the top of one evaporator is passed into the heat-exchanger section of the following evaporator via the pipes 30 and a sub-atmospheric pressure is maintained within the evaporators because the discharge pipe 31 of the last evaporator 27 is connected with a vacuum source. The spent heating medium from each evaporator 23–27 is passed through the inlet pipe 20 to the corresponding preheater in which it is used as indirect heating medium for the preheating of sugar juice.

The advantages obtained by the method of the invention are illustrated in the following examples 1–7 which disclose various tests conducted in the laboratory and in industrial scale and in example 8 which describes an embodiment of the process of the invention in industrial scale.

EXAMPLES 1–6

1.6 liter of samples of filtrate from the first carbonation station of a sugar factory and some with and other without additives for expediting the carbonation were treated with carbon dioxide to different pH values. The alkalinity (the number of millilitres 0.0357 N HCl per 0.1 ml juice required for titration to a pH value of 8.0) and the concentration of calcium salts (the number of millilitres 0.0357 N EDTA solution per 0.1 ml juice required for titration to colour change of the Eriochrome ® Black B indicator) were determined at each pH value. In this manner the optimum alkalinity of the filtrate supplied to the second carbonation step, i.e., the alkalinity at which the juice has the lowest concentration of calcium salts, can be determined.

By using soda and ammonium carbamate ($NH_2COONH_4$) as additives, the following results were obtained:

| Example | Additive: Compound | Additive: mg per liter juice | Optimum alkalinity, % CaO | Calcium salts at optimum alkalinity, % CaO |
|---|---|---|---|---|
| 1 | none | — | 0.007 | 0.015 |
| 2 | soda | 300 | 0.019 | 0.0054 |
| 3 | soda | 300 | 0.029 | 0.0043 |
| | $NH_2COONH_4$ | 292 | | |
| 4 | soda | 300 | 0.036 | 0.0034 |
| | $NH_2COONH_4$ | 438 | | |
| 5 | $NH_2COONH_4$ | 438 | 0.022 | 0.0069 |
| 6 | $NH_2COONH_4$ | 584 | 0.030 | 0.0056 |

The above results show that the addition of ammonia in the form of ammonium carbamate may wholly or partially replace the addition of soda, whether or not the substance is used alone or in combination with soda.

EXAMPLE 7

Tests comprising the addition of ammonia water in the form of a 25% aqueous solution were carried out in industrial scale. Over a period of 5 days the addition of soda was discontinued and ammonia water was pumped into the second carbonation container in an amount which was adjusted to the amount of juice introduced into the second carbonation station. It was found that the addition of soda in an amount of 350 g/t beets could be replaced by the addition of ammonia in an amount of 230 g 100% $NH_4$/t beets.

During the test period the concentration of sodium in the molasses produced decreased from about 8000–10000 ppm to 4700 ppm. The concentration of ammonia in the molasses produced increased from about 60 ppm to about 90 ppm.

In view of the fact that 1 kg of soda transfers 2.88 kg saccharose into the molasses (R.A. McGinnis: "Beet Sugar Technology", 3rd ed., 1982, p. 622) it is evident that by wholly or partially replacing soda with ammonia, the loss of saccharose to the molasses can be reduced.

EXAMPLE 8

In a sugar beet factory the discharge pipe from the 4th preheater was connected with a Richter-pipe placed along the Richter-pipe for carbon dioxide in the 2nd carbonation container via a stop valve.

Samples of juice produced in the factory were analyzed and the ammonia concentration was determined by using enzymatic reagents from Boehringer Mannhein GmbH, Diagnostica, Catalogue No. 125.857.

The data obtained are set forth in the following table:

| | Valve between the 4th preheater and 2nd carbonation container | | | |
|---|---|---|---|---|
| | Open | | Closed | |
| Juice | Dry matter, % | $NH_3$, ppm | Dry matter, % | $NH_3$, ppm |
| Diffusion juice | 16.5 | 16 | 16.4 | 14 |
| 1st carbonation filtrate | 16.3 | 78 | 15.6 | 71 |
| 2nd carbonation filtrate | 16.2 | 183 | 16.0 | 74 |
| thin juice | 16.4 | 194 | 16.0 | 78 |
| thick juice | 69.1 | 1 | 71.0 | 5 |

In periods in which the effluent from the 4th preheater of thin juice was recycled to the second carbonation step the consumption of soda was 80 g per t beets lower than in the periods in which the steam was discharged to the atmosphere and during which the consumption of soda was 300–400 g per t beets.

I claim:

1. A process for the production of sugar thick juice for the manufacture of sugar which process comprises the steps of (a) carbonating lime-containing raw sugar juice in at least one stage by adding thereto carbon dioxide and soda to precipitate excessive amounts of calcium ions in the form of calcium salts, (b) separating the precipitated calcium salts obtained in step (a) from the raw juice to form a thin juice, (c) indirectly preheating the thin juice with a heating medium, concurrently forming a gaseous medium containing ammonia, (d) evaporating the preheated thin juice obtained in step (c) to form thick juice and a gaseous effluent, said gaseous effluent being used as said heating medium in step (c), and (e) collecting at least part of the gaseous medium containing ammonia formed in step (c) and adding said gaseous medium to the lime-containing raw sugar juice during step (a) so as to reduce the amount of soda required to precipitate calcium salts and to increase the sugar yield in said thick juice.

2. A process according to claim 1, wherein carbonation step (a) comprises two stages, and wherein said gaseous medium is added to the lime-containing raw sugar juice during the second of said two carbonation stages.

3. A process according to claim 2, wherein the second carbonation stage is effected in two containers and wherein said gaseous medium is added to the lime-containing raw sugar juice contained in the first of said two containers.

4. A process according to claim 3, wherein said gaseous medium is liberated in the body of the raw sugar juice contained in the first of said two containers at a level located about 3–5 m below the surface of said body of raw sugar juice.

5. A process according to claim 2, wherein said indirect preheating step (c) is effected in a plurality of preheaters connected in series and at varying pressures and wherein the gaseous medium is collected from said preheaters wherein the pressure is superatmospheric.

6. An apparatus for the production of sugar thick juice comprising at least one carbonation container having inlet means for lime-containing thin juice, means for adding carbon dioxide and soda to said container and outlet means for a slurry of calcium salts and sugar juice, means for separating calcium salts from said slurry so as to form thin juice, a plurality of preheaters connected in series and having means for indirectly heating thin juice and for forming a gaseous medium containing ammonia, a plurality of evaporators connected in series, each evaporator comprising an evaporation zone and a steam zone, the steam zone of at least one evaporator being connected with said means for indirectly heating thin juice of at least one preheater, and means for collecting gaseous medium formed in at least one preheater and for introducing said gaseous medium into said carbonation container.

* * * * *